US007223215B2

(12) United States Patent
Bastyr

(10) Patent No.: US 7,223,215 B2
(45) **Date of Patent: *May 29, 2007**

(54) EXERCISE DEVICE WITH TRUE PIVOT POINT

(76) Inventor: Charles A. Bastyr, 12911 Via Grimaldi, Del Mar, CA (US) 92014

( * ) Notice: Subject to any disclaimer, the term of this patent is extended or adjusted under 35 U.S.C. 154(b) by 443 days.

This patent is subject to a terminal disclaimer.

(21) Appl. No.: 10/464,949

(22) Filed: Jun. 19, 2003

(65) Prior Publication Data

US 2003/0216229 A1 Nov. 20, 2003

Related U.S. Application Data

(63) Continuation-in-part of application No. 09/737,209, filed on Dec. 14, 2000, now Pat. No. 6,773,378.

(51) Int. Cl.
*A63B 21/015* (2006.01)
*A63B 21/012* (2006.01)

(52) U.S. Cl. ..... 482/115; 482/114; 482/118

(58) Field of Classification Search ..... 482/114–119, 482/121–126, 48–49, 51
See application file for complete search history.

(56) References Cited

U.S. PATENT DOCUMENTS

| | | | | |
|---|---|---|---|---|
| 363,522 | A | 5/1887 | Knous | |
| 631,276 | A | 8/1899 | Bulova | |
| 2,921,791 | A * | 1/1960 | Berne | 482/118 |
| 3,796,431 | A | 3/1974 | Sinyard | |
| 3,802,701 | A | 4/1974 | Good, Jr. | |
| 4,374,588 | A | 2/1983 | Ruggles | |
| 4,436,303 | A | 3/1984 | McKillip | |
| 4,618,139 | A | 10/1986 | Haaheim | |
| 4,684,126 | A | 8/1987 | Dalebout | |
| 4,850,585 | A | 7/1989 | Dalebout | |
| 4,915,374 | A | 4/1990 | Watkins | |
| 5,013,034 | A | 5/1991 | March | |
| 5,037,088 | A | 8/1991 | Bernstein | |
| 5,042,799 | A | 8/1991 | Stanley | |
| 5,062,633 | A | 11/1991 | Engel | |
| 5,158,519 | A | 10/1992 | Hughes | |
| 5,167,596 | A | 12/1992 | Ferber | |
| 5,244,446 | A | 9/1993 | Engel | |
| 5,282,776 | A * | 2/1994 | Dalebout | 482/118 |
| 5,324,247 | A * | 6/1994 | Lepley | 482/134 |

(Continued)

*Primary Examiner*—Jerome Donnelly
*Assistant Examiner*—Fenn C. Mathew
(74) *Attorney, Agent, or Firm*—Nydegger & Assoc.

(57) ABSTRACT

An exercise device with a true pivot point includes a plurality of arms that are joined at a joint assembly. A first arm is fixed in relation to the joint assembly and is also stabilized by a base member at an end opposite the joint assembly. In one embodiment, the base member is a foot pedal and in another embodiment the base member is a frame that includes a seat for the user. A second arm (or in some cases a pair of arms) rotates about an axis of rotation which is defined by the joint assembly. A resistance mechanism is contained in the joint assembly which includes a one-way clutch interconnected with the second arm to allow the second arm to rotate freely in a first direction. Rotation by the second arm in direction opposite the first, however, engages the resistance mechanism to create a user-selected resistance to rotation.

19 Claims, 11 Drawing Sheets

U.S. PATENT DOCUMENTS 5,445,581 A 8/1995 Ferber
5,454,769 A 10/1995 Chen
5,460,586 A 10/1995 Wilkinson
5,507,712 A * 4/1996 Chang ..... 482/126
5,755,646 A * 5/1998 Chu ..... 482/118
5,830,107 A * 11/1998 Brigliadoro ..... 482/1
6,244,988 B1 6/2001 Delman

* cited by examiner

EXERCISE DEVICE WITH TRUE PIVOT POINT

This application is a continuation-in-part of application Ser. No. 09/737,209 filed Dec. 14, 2000 now U.S. Pat. No. 6,773,378. The contents of application Ser. No. 09/737,209 are incorporated herein by reference.

FIELD OF THE INVENTION

The present invention pertains generally to physical exercise devices. More specifically, the present invention pertains to portable exercise devices and methods for using these devices. The present invention is particularly, but not exclusively, useful as an adjustable exercise device which allows the individual user to selectively stabilize the device during an exercise routine.

BACKGROUND OF THE INVENTION

As is well known, a wide variety of exercise equipment is commercially available for purchase and use by individuals for purposes of developing their overall strength and physical condition. Often this equipment is designed for specific purposes, such as for exercising targeted muscle groups. The more complex and comprehensive the exercises become, however, it often happens that the exercise equipment also becomes more complex, more bulky, and less mobile. Similarly, exercise equipment that is designed for multiple exercises and for exercising multiple muscles becomes more complex, bulky and less mobile.

In general, exercise equipment can be categorized as being either stationary equipment or portable equipment. Typically, stationary equipment is found in gyms, athletic facilities, training centers, and to a lesser degree in homes, and involves floor-mounted frames that normally incorporate heavy weights or other force generating mechanisms. An important reason for using stationary exercise equipment is that such equipment adds an element of stability to an exercise routine and provides a means for reacting forces being applied by the user to the equipment. In many exercise routines, and particularly those that are designed for physical therapy purposes, this element of stability may be very desirable. For instance, whenever there is a targeted muscle group, it may be important to insure that the muscle group is properly exercised. This means the exercise routine should involve repetitively consistent muscle contractions against a resistance of predictable magnitude and direction. To achieve these objectives, it is necessary to somehow stabilize the equipment. This is easily done with stationary equipment. By definition, however, stationary equipment is not portable and requires a dedicated area for its location.

The use of portable exercise equipment has several advantages. One such advantage is availability. The convenience of being able to carry the equipment from site to site can be of considerable value to a user. This value can be significantly increased if the equipment itself is relatively lightweight and easy to handle. Further, as implied above in the context of stationary equipment, the versatility of portable exercise equipment can be significantly increased if it is somehow capable of being stabilized so that it is possible to reliably and consistently perform the repetitions of an exercise routine and be used at physiologically significant load levels. It is a further advantage if the portable exercise equipment can be quickly, easily, and conveniently configured for use when initiating an exercise session, and for performing a variety of exercise routines.

In light of the above, it is an object of the present invention to provide a portable exercise device which can be stabilized during an exercise routine. Another object of the present invention is to provide an exercise device which includes an adjustable mechanism that will reliably and repeatedly provide a desired resistance to the user during an exercise routine. Another object of the present invention is to provide an exercise device that can be easily and quickly configured by the user to perform a variety of exercises. Another object of the present invention is to provide an exercise device that can be used for exercising various muscles within the body of the user. Another object of the present invention is to provide an exercise device that does not interfere with or constrain normal joint biomechanics during the user's performance of exercise routines with the device. Another object of the present invention is to provide an exercise device for use by an individual which is compact, portable, and safe. Yet another object of the present invention is to provide an exercise device which is relatively simple to manufacture, is easy to use and is comparatively cost effective.

Other objects, features and advantages of the present invention will become apparent from the following description, taken in conjunction with the accompanying drawings, which illustrate, by way of example, the principle of the invention.

SUMMARY OF THE INVENTION

An exercise device includes a first arm, a second arm and a joint assembly that interconnects the first arm with the second arm. In one embodiment, a third arm is included that rotates together with the second arm. For reference purposes, the joint assembly defines an axis of rotation that is substantially perpendicular to both the first arm and the second arm. Within this assembly, the first arm can be considered as having a fixed relationship with respect to the axis. On the other hand, the second arm is able to rotate about the axis. More specifically, the second arm (and in some cases a third arm) is able to rotate freely in one direction around the axis, while being restrained by a resistance during a rotation in the opposite direction.

Included in the joint assembly is a one-way clutch that is fixed to a cone member. A shaft that is fixed to the second arm is positioned within the one-way clutch. Through the action of the one-way clutch, the cone member moves together with the second arm when the second arm is moved in a first direction, but it does not move with the second arm when the second arm is moved in the opposite direction. Also included in the joint assembly, along with the cone member, are a cup member and a friction liner. More specifically, both the cone member and the cup member have tapered surfaces that conform to each other, and the friction liner is positioned between these surfaces at their interface. Further, the cup member is connected directly to the first arm. An alternate embodiment is envisioned for the present invention which will not employ the one-way clutch. In this embodiment the cone member will move with the second arm in both directions.

In the operation of the exercise device, the first arm is stabilized and the second arm rotates freely about a rotation axis in the direction wherein the one-way clutch does not engage the second arm with the cone member. Specifically, the shaft rotates freely within the one-way clutch. On the other hand, when the second arm is moved in the opposite direction, i.e. the direction wherein the one-way clutch fixedly engages the shaft with the cone member, the second arm will encounter resistance to rotation. Specifically, when the one-way clutch becomes engaged, the tapered surface of the cone member will move relative to the tapered surface of the cup member. This movement will involve the friction liner and will generate a force that resists the rotation and is substantially constant throughout the movement. It will be appreciated by the skilled artisan that whenever there is no relative movement between the arms, i.e. when the second arm is stationary relative to the first arm, there is zero stored energy in the exercise device.

Several alternate embodiments are envisioned for the present invention which will respectively use different mechanisms for generating a one-way or two-way resistance to the relative movement between the second arm and the first arm. Specifically, a spring or an elastomeric material can be positioned in the joint assembly and oriented to resist any relative movement of the second arm in a predetermined direction of rotation. Further, pneumatic, hydraulic, viscous shear, magnetic or electromagnetic systems can be used for this purpose.

In one embodiment of the exercise device, control over the amount of the resistance there is to a rotation of the second arm, relative to the first arm, is accomplished at the joint assembly. Specifically, for this purpose the joint assembly can include a knob which is mounted on the cup member. This knob has a threaded connection with a plunger so that rotations of the knob will cause a translational movement of the plunger. The plunger, in turn, is in contact with a spring which is compressed or allowed to elongate with rotations of the knob, and this spring interacts with the cone member. Thus, in combination, a rotation of the knob activates the spring to urge the tapered surface of the cone member against the friction liner on the tapered surface of the cup member. Accordingly, depending on the direction the knob is rotated, the resistance to rotation between the cup member and cone member can be increased or decreased. There may also be a spring-loaded detent that is mounted on the cup member so that when the knob is turned, the detent is urged against detent notches in the knob to provide an aural signal in response to the rotation of the knob.

In another embodiment of the exercise device, a lever is provided to adjust the rotation resistance of the second arm, relative to the first arm. For this embodiment, a plate is attached to the cup member and a threaded extension is attached to the lever. The extension is threadably engaged with the plate and a spring is interposed between the threaded extension and the cone member. With this cooperation of structure, the lever can be moved by the user to rotate the threaded extension and thereby selectively compress or expand the spring. The spring, in turn, establishes a rotation resistance between the cup member and cone member at their interface. Thus, in combination, a movement of the lever activates the spring to urge the tapered surface of the cone member against the friction liner on the tapered surface of the cup member. Accordingly, depending on the direction the lever is moved, the resistance to rotation between the cup member and cone member can be increased or decreased.

As indicated above, the first arm of the device is stabilized as the second arm of the device is rotated against the resistance created by the resistance mechanism. To do this, the first arm is stabilized by a base member at an end opposite the joint assembly. In one embodiment, the base member is a foot pedal, and in another embodiment the base member is a frame that includes a seat for the user. Alternatively, however, the stabilizing mechanism may be a friction surface, a mounting bracket, a handle, or some other suitable stabilizing element.

The second arm can include an input mechanism that is located at the end of the second arm opposite the joint assembly. Preferably, this mechanism is a handle that can be placed in a variety of positions.

The present invention also envisions that a position sensor can be mounted on the device to monitor repetitions in an exercise routine. If used, the sensor can generate signals which represent changes in the relative positions of the arms of the device. These changes can then be timed and used to count repetitions or cycle duration that may be useful for monitoring the exercise routine. A computer or microprocessor interface can also be established to monitor the signals that are generated by the position sensor.

It is further envisioned that a load or strain sensor can be mounted on the device to monitor the load applied by the user of the device to rotate the second arm against the resistance created by the resistance mechanism. If used, the sensor can generate a signal that is proportional to the magnitude of force applied by the user of the device. This signal can be used to calculate the peak, average, and minimum load applied by the user in each exercise cycle. The signal can also be monitored and timed to count repetitions or cycle duration. A computer or microprocessor interface can also be established to monitor the signals that are generated by the load or strain sensor, and to calculate and display other useful exercise information.

During an exercise routine, the exercise device of the present invention can be used by an individual to perform, for example, biceps exercises. To do this, the individual sets the resistance according to his or her strength and exercise goals. Once the resistance is set, the individual user then stabilizes the first arm of the device by stepping on the foot pedal (if provided) or for some exercises by sitting on the seat (if provided). While positioning the elbow in close alignment with the axis of rotation of the joint assembly, the individual can then grasp the handle that is attached to the extended end of the second arm. The second arm can then be rotated in a clockwise or a counterclockwise rotation about the joint assembly. In one scenario, a clockwise rotation produces resistance as the targeted muscles contract. During a counterclockwise rotation, however, the resistance is released, and the second arm can be returned to its initial position. For subsequent exercise routines, the resistance can be increased as the muscles become stronger. Further, the device can be easily and quickly reconfigured to change the direction of resistance or to change to other configurations so that the user can alter body positions or alter the relationship of the device relative to the user for other exercise routines and for exercising other muscles.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
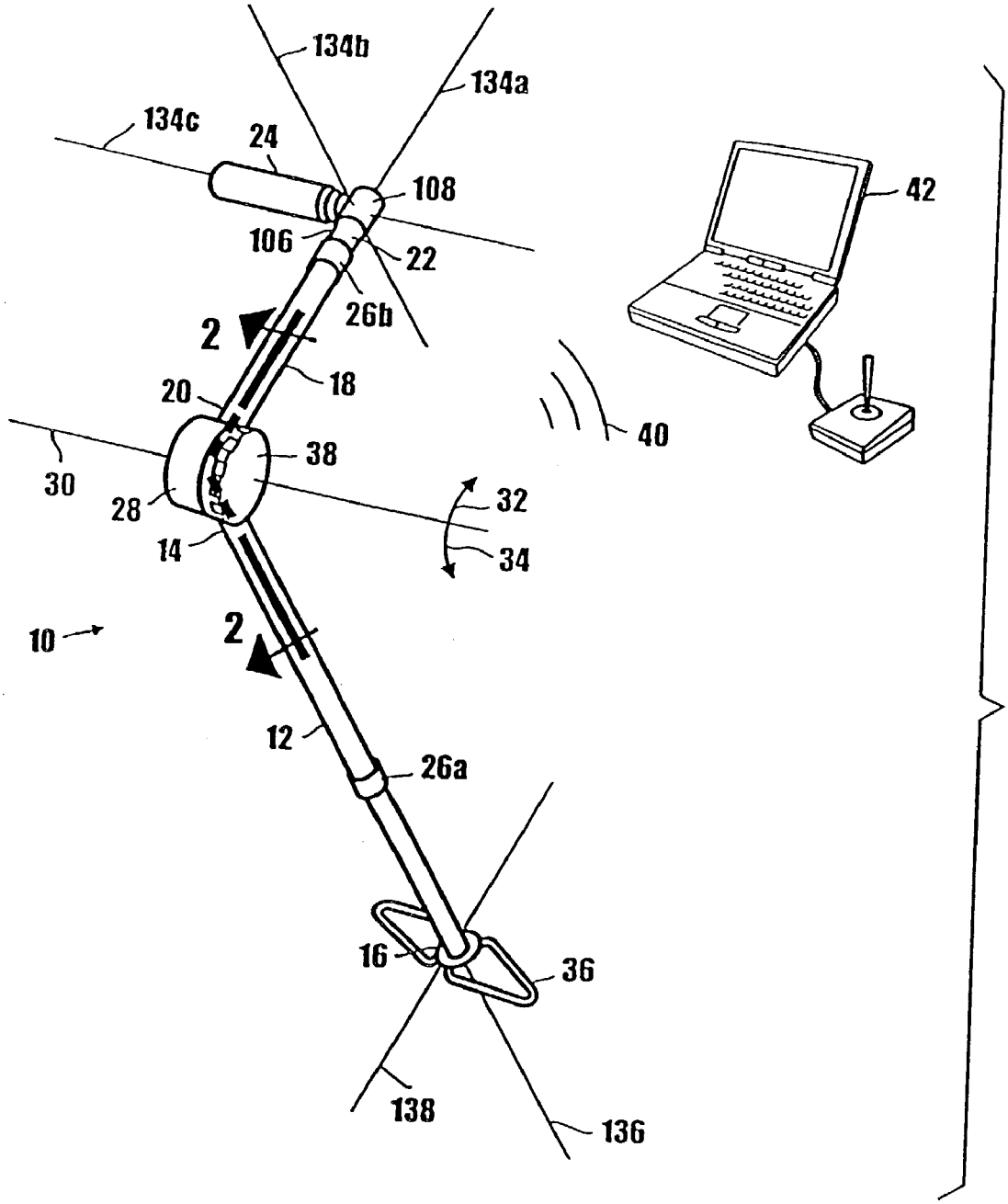
FIG. 1 is a perspective view of an exercise device shown with peripheral computer equipment.

A first embodiment of an exercise device is shown in FIG. 1 and is generally designated 10. As shown, the device 10 includes a first arm 12, which has a first end 14 and a second end 16. The device 10 also has a second arm 18 which has a first end 20 and a second end 22. As shown in FIG. 1, the second arm 18 has a handle 24 that is attached at its second end 22. It is to be appreciated, however, that the handle 24 can be pivoted about the end 22 through an arc of approximately one hundred and eighty degrees so that the handle 24 extends from the arm 18 in a direction opposite to that shown in FIG. 1. Additionally, both the first arm 12 and the second arm 18 have respective locking rings 26*a* and 26*b* that can be manipulated in a manner well known in the art to telescopically adjust the respective lengths of the arms 12 and 18.

FIG. 1 also shows that the device 10 includes a joint assembly 28 which, for reference purposes, defines an axis of rotation 30. In their relationship to this axis of rotation 30, the first arm 12 is attached to the joint assembly 28 to establish a fixed relationship between the first arm 12 and the axis of rotation 30. On the other hand, the second arm 18 is pivotally attached to the joint assembly 28 for a reciprocal rotation of the second arm 18 about the axis of rotation 30. More specifically, this rotation of the second arm 18 about the axis of rotation 30 can be in either a clockwise direction 32 or in a counterclockwise direction 34. It is to be appreciated that the second arm 18 as shown in FIG. 1 can be rotated to other positions about the axis of rotation 30 to establish alternate exercise configurations of the device 10.

In the embodiment of the device 10 shown in FIG. 0.1, a foot pedal 36 is attached to the second end 16 of the first arm 12 such that the foot pedal 36 can rotate about axis 138 or an axis substantially parallel to and in close approximation to axis 138. During use of device 10, the foot pedal 36 is placed at a position located approximately ninety degrees relative to arm 12. However, this angle can vary during use of device 10 to accommodate normal biomechanical motions. For storage, the foot pedal 36 can be rotated to a position next to arm 12, substantially parallel to axis 136. It is also envisioned that a position sensor 38 can be mounted on the device 10, possibly at the joint assembly 28, to generate signals 40 that are representative of the relative positions of said first arm 12 and said second arm 18 of the device 10. Specifically, these signals 40 can be generated in a manner well known in the pertinent art and transmitted to a remote computer 42 or other electronic monitoring device for processing. More specifically, the signals 40 can be used to indicate the position of the first arm 12 relative to the second arm 18, and to measure the time duration between changes in the relative positions of said first arm 12 and said second arm 18 of the device 10. It is further envisioned that a load sensor 106, such as a strain gauge, can be mounted on the device 10, possibly near handle 24, to generate signals 40 that are representative of the loads that are applied to the handle 24 of device 10. These signals 40 also can be generated in a manner well known in the pertinent art and transmitted to a remote computer 42 or other electronic monitoring device for processing and displaying useful information regarding exercise sessions. Thus, exercise repetitions, the duration of each repetition, and the load applied by the user 90 (FIG. 5A) during each repetition in an exercise routine can be monitored. Furthermore, other exercise performance information and data can be determined from the signals 40.

Figure 2:
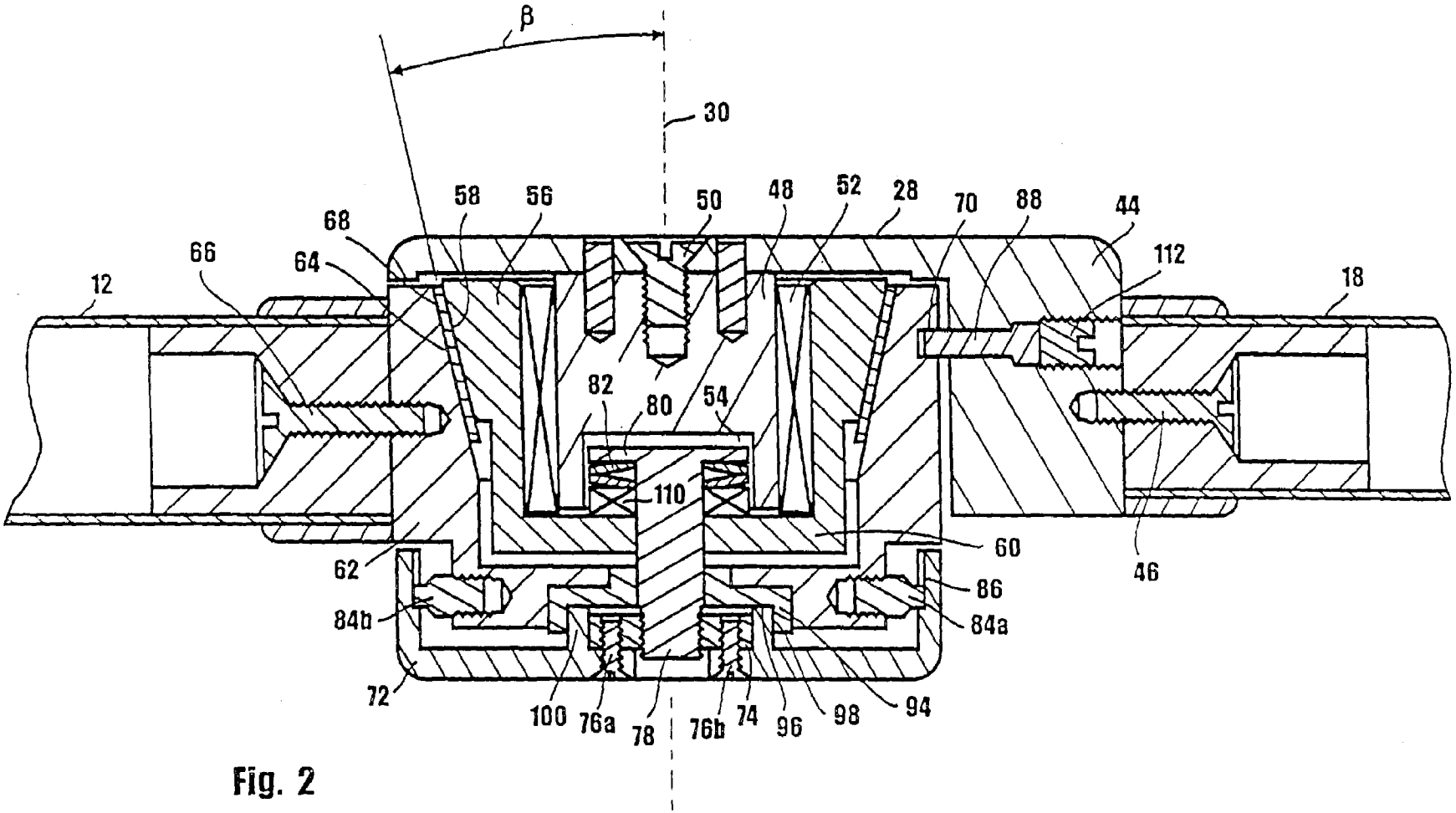
FIG. 2 is a cross sectional view of a joint assembly for an exercise device such as the device shown in FIG. 1 as would be seen along a line 2—2 in FIG. 1 when the device is straightened.

Turning now to FIG. 2, the resistance mechanism that is incorporated into the joint assembly 28 of the device 10 is shown in detail. There it can be seen that the arm 18 is connected to an extension member 44 by means, such as the screw 46, and that the extension member 44 is connected to a shaft 48 by means, such as the screw 50. As shown, the shaft 48 is centered on the axis of rotation 30. Further, the resistance mechanism includes a circular one-way clutch 52, of a type well known in the pertinent art. The one-way clutch 52 may also have an integral bearing assembly. For example, the one-way clutch can be a Torrington Type DC Roller Clutch and Bearing Assembly, part number RCB-162117. Those of ordinary skill in the art will understand, however, that the one-way clutch 52 may comprise a variety of suitable devices. The one-way clutch 52 is also centered on the axis of rotation 30 and the shaft 48 is formed with a recess 54.

A cone member 56 is included in the joint assembly 28 and is positioned against the one-way clutch 52. As shown in the preferred embodiment, this cone member 56 is formed with a tapered surface 58 that surrounds the axis of rotation 30 and is angled relative to the axis of rotation 30 at angle β. Preferably, angle β is between ten and fifteen degrees. However, those of ordinary skill in the art will understand that there are many suitable values for angle β including ninety degrees, in which case tapered surface 58 will be substantially perpendicular to the axis of rotation 30. Additionally, the cone member 56 includes a rim 60 that is oriented radially on the axis of rotation 30. This rim 60 projects over the recess 54 of the shaft 48 substantially as shown. Also included in the joint assembly 28 is a cup member 62 which has a tapered surface 64, and which is attached directly to the arm 12 by means such as the screw 66. Importantly, the tapered surface 64 of the cup member 62 is dimensioned to mate with the tapered surface 58 of the cone member 56. As intended for the device 10, a friction liner 68 is positioned between the respective tapered surfaces 58 and 64 of the cone member 56 and the cup member 62. Preferably, the friction liner 68 is fixed to either the cone member 56 or the cup member 62. Also, the cup member 62 is formed with an annular groove 70 that is substantially centered on the axis of rotation 30.

Still referring to FIG. 2, it is seen that the joint assembly 28 includes a knob 72 that is connected to a threaded ring 74 by means such as the screws 76*a* and 76*b*. Further, the ring 74 is threadably engaged with a plunger 78. As shown, the plunger 78 is formed with a flange 80 that is inserted into the recess 54 of the shaft 48. Additionally, a force transfer mechanism, such as a spring 82, and a thrust bearing 110 are positioned in the recess 54 between the flange 80 of plunger 78 and the rim 60 of cone member 56. The relative position of spring 82 and thrust bearing 110 is interchangeable. For example, the spring 82 can include two Berg belleville washers, part number St-7, stacked in a parallel configuration, and thrust bearing 110 can be a Torrington thrust needle roller and cage assembly, part number NTA-411 and two thrust washers, part number TRA-411. However, those of ordinary skill in the art will understand the spring 82 and the thrust bearing 110 may comprise a variety of suitable devices. A bushing 94 is mounted on the cup member 62 and is constrained from rotating about the axis of rotation 30 with respect to cup member 62 by means well known by those of ordinary skill in the art. Flange 100 of the knob 72 is positioned against the bushing 94, and the knob 72 is constrained from translating along the axis of rotation 30 by radial surface 96 of bushing 94 and from moving in a radial direction relative to the axis of rotation 30 by the annular surface 98 of the bushing 94.

Figure 3:
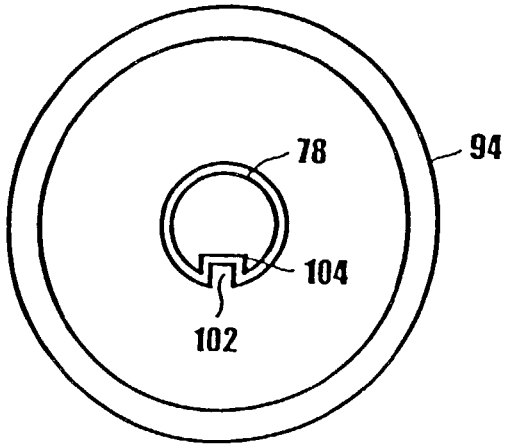
FIG. 3 is a plan view of the interconnection between the plunger and bushing of the joint assembly shown in FIG. 2, as seen looking along the axis of rotation shown in FIG. 2.

Turning to FIG. 3, it is seen that bushing 94 has a key 102 that protrudes into keyway 104 in plunger 78. The interaction of the key 102 with the keyway 104 prevents the plunger 78 from rotating with respect to the bushing 94 and limits its motion to translation along the axis of rotation 30.

Referring again to FIG. 2, a plurality of spring-loaded detents 84, of which the detents 84*a* and 84*b* are only exemplary, can be mounted on the cup member 62 to urge against the knob 72. Further, the knob 72 can be formed with a plurality of recesses 86 so that as the knob 72 is rotated, the spring-loaded detents 84 will come into contact with the recesses 86 and thereby make an aural "clicking" sound. The contact of the detents 84 with the recesses 86 also provides incremental rotational setting of the knob 72 wherein there is a slight resistance to rotation of the knob 72 at each of these settings. As an additional matter, it is to be noted that a guide pin 88 is mounted on the extension member 44 and is inserted into the annular groove 70. Thus, a rotation of the arm 18 around the axis of rotation 30 will be controlled by the interaction of the guide pin 88 in the groove 70, preventing arm 18, extension member 44 and shaft 48 from translating along the axis of rotation 30 relative to the cup member 62. The guide pin 88 is held in position by set screw 112.

In the operation of the device 10, a user 90 will first adjust the exercise resistance that is to be provided by the joint assembly 28. Specifically, this is accomplished by rotating the knob 72. With reference to FIG. 2, it will be appreciated by a skilled artisan that a rotation of the knob 72 causes the threaded ring 74 to interact with the plunger 78 in a way that will effect a translational movement of the plunger 78. Accordingly, depending on the direction that knob 72 is rotated, the plunger 78 will either advance into the recess 54 or be withdrawn from the recess 54. The consequence of this is that the force transfer mechanism (spring 82) will be respectively relaxed or compressed between the flange 80 of plunger 78 and the rim 60 of cone member 56. In either case, the force that is generated by the spring 82 will act against the cone member 56. Importantly, this force will be effectively transferred through the cone member 56 to establish a reactive force on the friction liner 68 at the interface between the tapered surface 58 of the cone member 56 and the tapered surface 64 of the cup member 62. Furthermore, utilizing a force transfer mechanism (spring 82) allows the knob 72 to be rotated through larger angles in adjusting the exercise resistance from its lowest setting to its highest setting than would be possible if a force transfer mechanism was not employed.

Through the action of the one-way clutch 52, the arm 18 and its extension member 44 are able to freely rotate about the axis of rotation 30 when the arm 18 is rotated in a predetermined direction, e.g. the clockwise direction 32. On the other hand, the one-way clutch 52 will fixedly engage the arm 18 with the cone member 56 when the arm 18 and its extension member 44 are rotated in the opposite direction, e.g. the counterclockwise direction 34. As a consequence, when the arm 18 is fixedly engaged with the cone member 56 through the one-way clutch 52, the rotation of the arm 18 will encounter the resistance that is established on the friction liner 68 between the cone member 56 and the cup member 62. As indicated above, the amount of this resistance is established by rotating the knob 72. Importantly, through the action of key 102 and thrust bearing 110, plunger 78 and knob 72 are prevented from rotating when the action of the one-way clutch 52 causes cone 56 to rotate with respect to cup 62 as arm 18 is rotated. Further, the audible "clicks" that result when the detents 84*a,b* pass over recesses 86, together with a visible gauge (not shown), can be used for determining preferred resistance levels.

Figure 4:
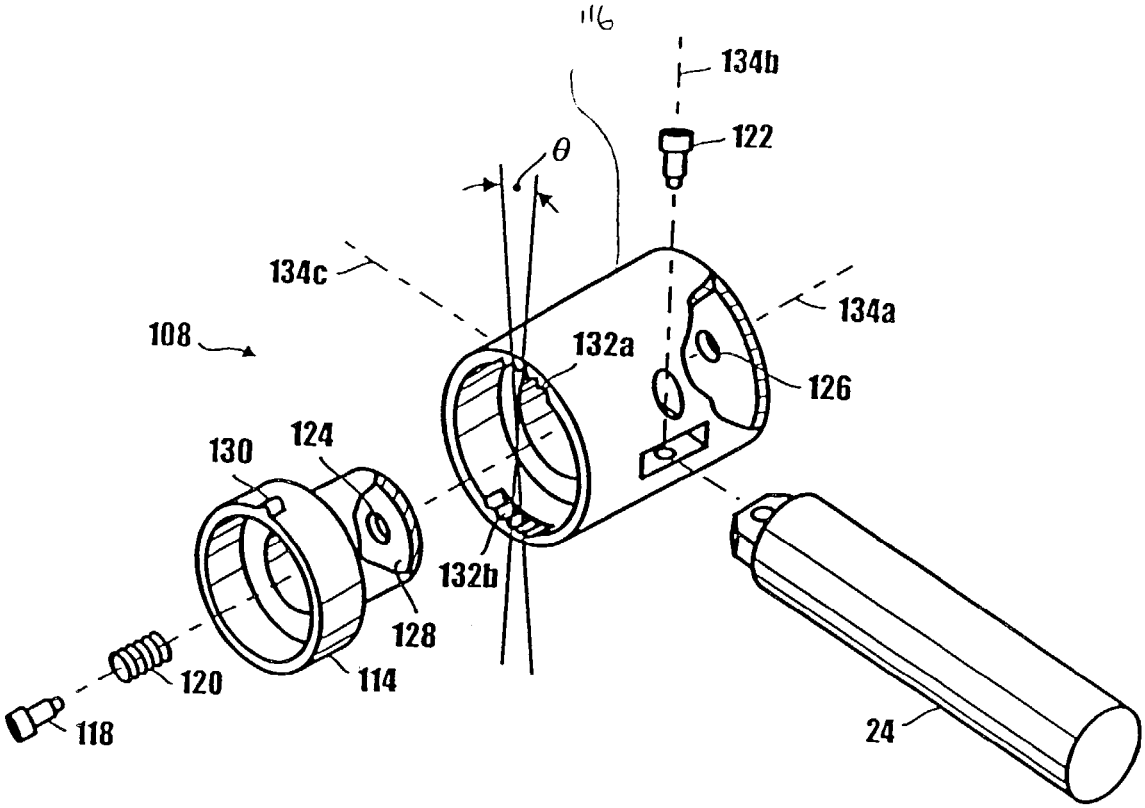
FIG. 4 is an exploded view of a handle assembly.

Turning now to FIG. 4, the handle assembly 108 of device 10 is shown in detail. There it can be seen that the handle 24 is connected to the outer hub 116 by means such as the shoulder screw 122. As shown, the shoulder screw 122 is centered on the axis 134*b*. The handle 24 is free to rotate about the axis 134*b*, out of alignment with axis 134*c*, approximately thirty degrees in a clockwise direction and a counterclockwise direction. A plurality of notches 132*a* and a plurality of notches 132*b* are formed on the inside circumference of outer hub 116. The notches 132*a* are oriented at angle θ with respect to each other. Likewise, the notches 132*b* are oriented at angle θ with respect to each other. Preferably, the angle θ is equal to about ten degrees. The notches 132*a* and 132*b* are oriented one hundred and eighty degrees with respect to each other about axis 134*a*. Inner hub 114 has at least one key 130 formed on its outer circumference. The key 130 is dimensioned to mate with the notches 132*a* and the notches 132*b*. The inner hub 114 fits within the outer hub 116 such that the key 130 fits securely within one of the notches 132*a* or one of the notches 132*b*.

The inner hub 114 is attached to the outer hub 116 by the shoulder screw 118 and the spring 120. The shoulder screw 118 passes through the spring 120 and through the hole 124 in inner hub 114 and threads into the hole 126 in the outer hub 116. As shown, the screw 118 and the spring 120 are centered on the axis 134*a*. The spring 120 is constrained between the head of shoulder screw 118 and the inner surface 128 of the inner hub 114, biasing inner hub 114 within outer hub 116.

To configure the handle assembly 108 for an exercise routine, the outer hub 116 is translated relative to the inner hub 114 along axis 134*a*, compressing the spring 120 to a position where key 130 is clear of the notches 132*a* and the notches 132*b*. In this position, the outer hub 116 can be rotated about axis 134*a* to a position where key 130 will align with any of the plurality of notches 132*a* or the plurality of notches 132*b*. Preferably, one of the notches 132*a* and one of the notches 132*b* are oriented on the inside circumference of the outer hub 116 such that the handle 24 will be aligned with axis 134*c* when the key 130 engages either of these notches. The inner hub 114 is attached to end 22 of arm 18 by means well known by those skilled in the art.

For the device 10, the ability of the handle 24 to freely rotate about axis 134*b*, and to be selectively and fixedly positioned about axis 134*a*, allows device 10 to be configured for the correct anatomical position and biomechanical motion of the hand, wrist and joints of the user 90, both before and during an exercise routine cycle.

Figure 5A:
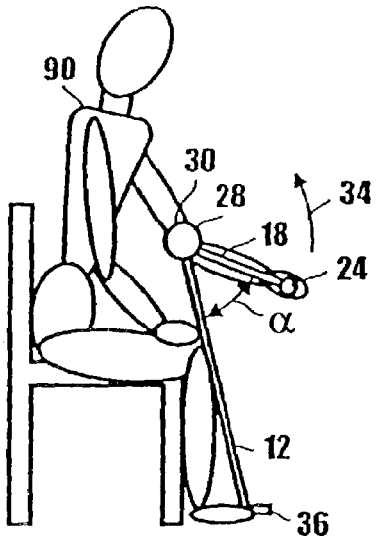
FIG. 5A is a side elevation view of a user with the exercise device shown in FIG. 1, positioned with the joint assembly at the elbow point being exercised) and with the user's arm extended.
Figure 5B:
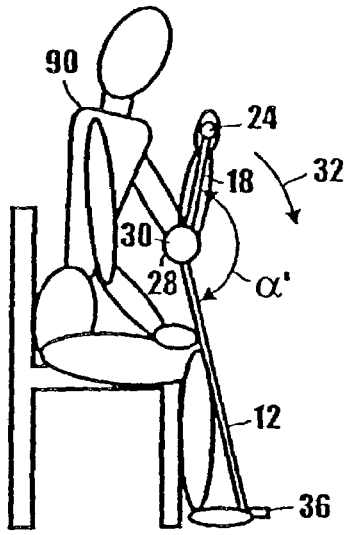
FIG. 5B is a side elevation view of a user with the exercise device shown in FIG. 1, positioned with the joint assembly at the elbow (joint being exercised) and with the user's arm flexed.

FIGS. 5A and 5B show an exemplary use of the device 10 wherein the axis of rotation 30 is positioned close to the axis of rotation of the joint of the user 90 that is to be flexed and extended during an exercise routine. In this example, the elbow of the user 90. The device 10 is stabilized by the user 90 by stepping on the foot pedal 36. Rotation of the handle 24 by the user 90 in a counterclockwise direction 34 (FIG. 5A) will be met by a resistance force generated by the joint assembly 28 as the arm 18 is rotated about the axis of rotation 30. Conversely, rotation of the handle 24 by the user 90 in a clockwise direction 32 (FIG. 5B) will meet no resistance from the joint assembly 28 as the arm 18 is rotated about the axis of rotation 30. Further, the direction in which the resistance force acts can be reversed by first rotating the device 10 approximately one hundred and eighty degrees about axis 136 (FIG. 1) and then, if needed, rotating the handle 24 about the axis of rotation 30 or the axis 134*a* to place the handle 24 in the desired position for the exercise to be performed. The arms 12 and 18 can be lengthened or shortened to effect other exercises.

Figure 6A:
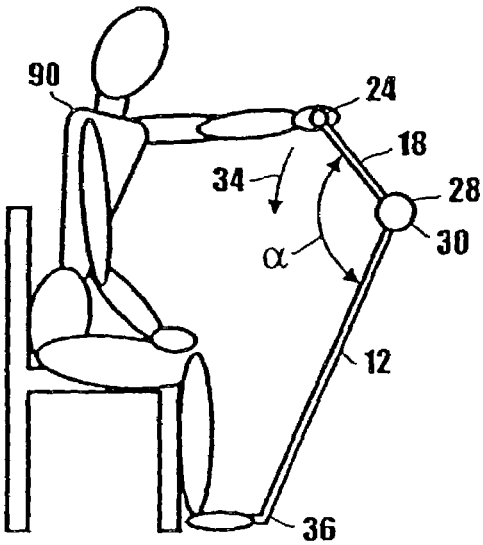
FIG. 6A is a side elevation view of a user with the exercise device shown in FIG. 1, positioned with the joint assembly remotely positioned and with the user's arm elevated.
Figure 6B:
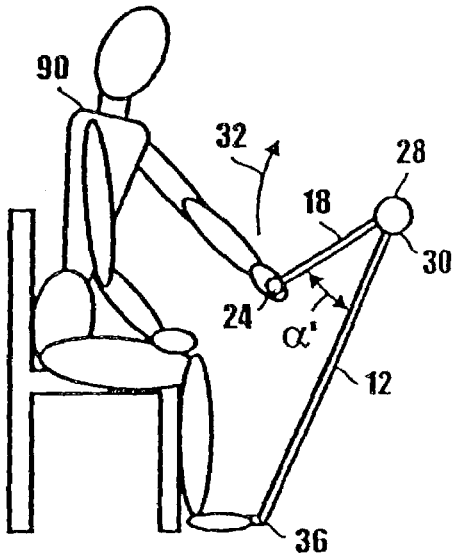
FIG. 6B is a side elevation view of a user with the exercise device shown in FIG. 1, positioned with the joint assembly remotely positioned and with the user's arm lowered.

FIGS. 6A and 6B show a use of the device 10 wherein the axis of rotation 30 on the device 10 is positioned at a distance from the axis of rotation of the joint of the user 90 that is to be flexed and extended during the exercise routine. In this example, the shoulder of the user 90.

Figure 7A:
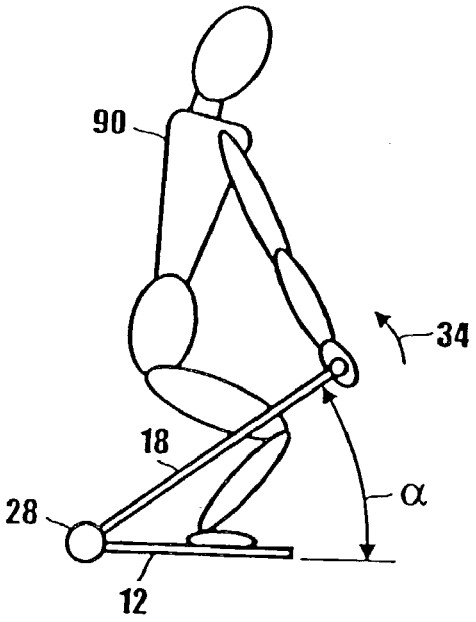
FIG. 7A is a side view representation of a user operating the exercise device shown in FIG. 1 with rotation in one direction.
Figure 7B:
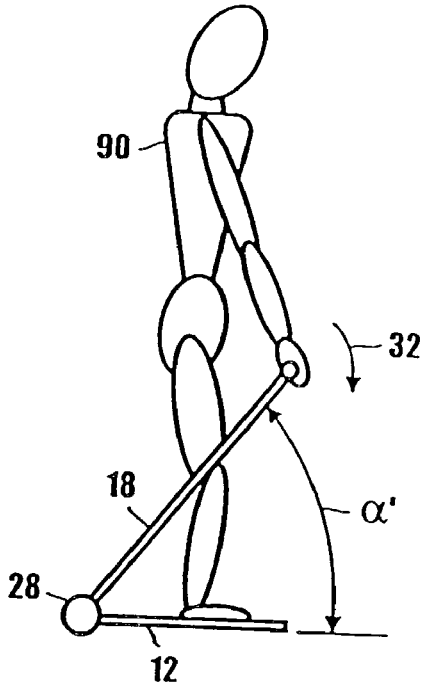
FIG. 7B is a side view representation of the user operating the exercise device shown in FIG. 1 with a rotation in a direction opposite to the rotation direction shown in FIG. 7A.
Figure 8:
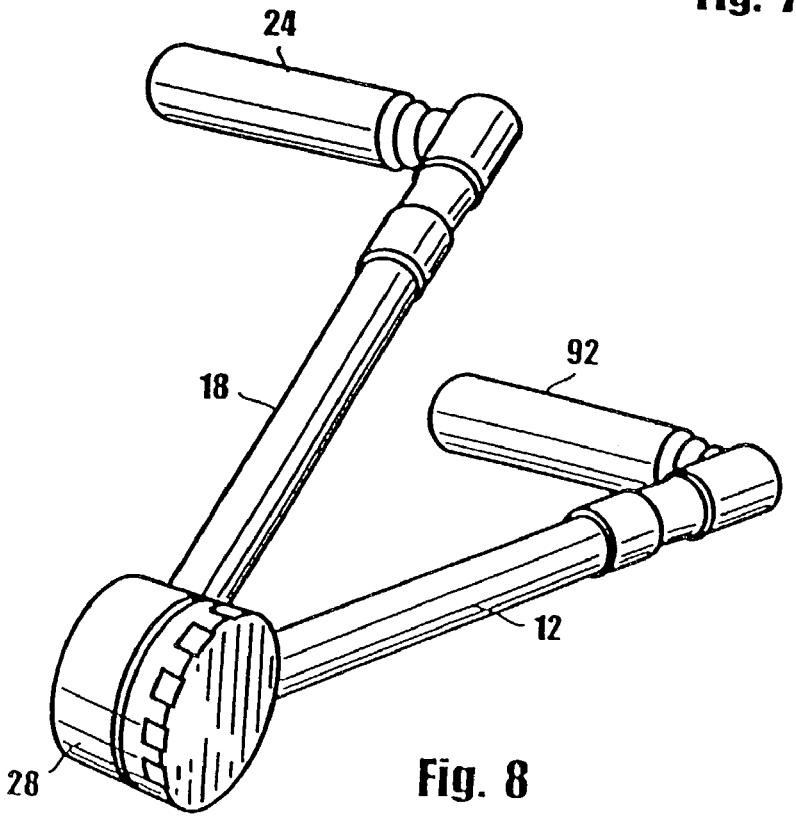
FIG. 8 is a perspective view of an alternative embodiment of an exercise device.

FIGS. 7A and 7B show that as an alternative to stabilizing the device 10 by stepping on the foot pedal 36, the user 90 can otherwise stabilize the device 10 by stepping on the arm 12. Then, for example, movements of the user 90 from a leaning position (FIG. 7A) to a standing position (FIG. 7B) can be met by a resistance force. Specifically, this resistance force will be generated by the joint assembly 28 as the arm 18 is rotated about the axis of rotation 30 in the direction 34. Conversely, movements of the user 90 from the standing position (FIG. 7B) to the leaning position (FIG. 7A) will meet no resistance from the joint assembly 28 as the arm 18 is rotated about the axis of rotation 30 in the direction 32. Additionally, in an alternate embodiment of the device 10 shown in FIG. 8, the foot pedal 36 can be replaced by a handle 92. Regardless of which embodiment of the device 10 is contemplated, the position sensor 38 can be used to monitor or guide the exercise routine of the user 90. For example, in addition to the signals 40 containing time information data, the signals 40 can also convey information about the relative positions of said first arm 12 and said second arm 18 of the device 10. Thus, returning to FIGS. 5A and 5B, the signals 40 can include information on the angle $\alpha$ between the arm 12 and the arm 18 (FIG. 5A), and changes in this angle $\alpha$ to the angle $\alpha'$ (FIG. 5B). Furthermore, the load sensor 106, either in combination with the position sensor 38 or alone, can be used with any of the embodiments of the device 10 to monitor or guide the exercise routine of the user 90. The signals 40 can also contain data regarding the magnitude of the force applied by the user 90 to the device 10 to overcome the resistance force generated by the joint assembly 28 as the arm 18 is rotated from a position at angle $\alpha$ from arm 12 (FIG. 5A) to a position at angle $\alpha'$ from arm 12 (FIG. 5B). Additionally, the signals 40 can contain data regarding the magnitude and relative direction of the force applied by the user 90 of the device 10 in returning the arm 18 from angle $\alpha'$ to angle $\alpha$. Such information and data, of course, can be useful for monitoring both the duration and the extent of exercise routines conducted with the device 10 as well as the magnitude of the loads applied to the device 10 by the user 90 during the exercise routines. This information and data can also be used by the computer 42 or other electronic monitoring devices to perform calculations and analysis of the exercise routines.

Figure 9:
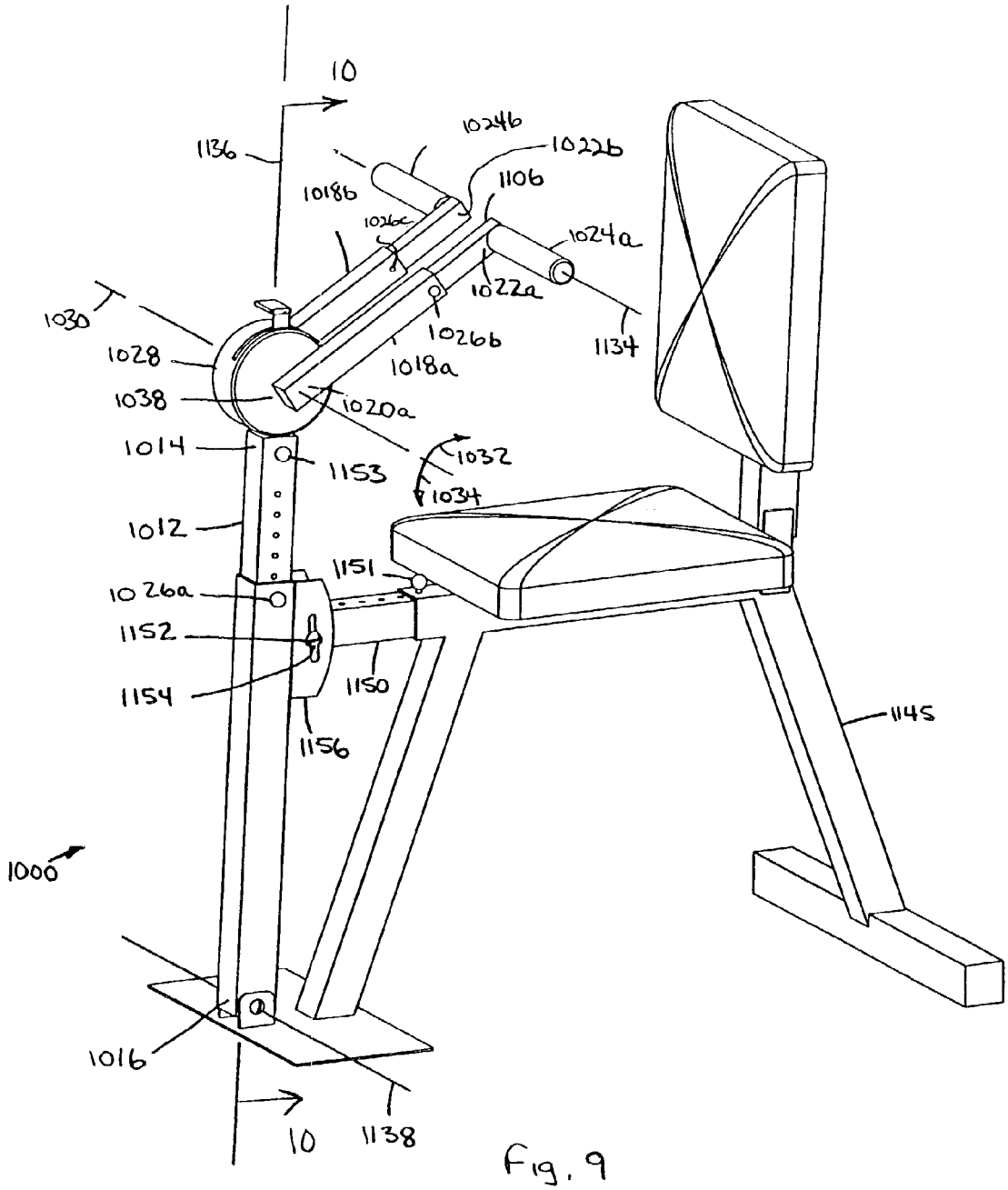
FIG. 9 is a perspective view of an alternative embodiment of an exercise device.

Another embodiment of an exercise device is shown in FIG. 9 and is generally designated 1000. As shown, the device 1000 includes a first arm 1012, which has a first end 1014 and a second end 1016. The device 1000 also has second and third arms 1018*a,b* which each have a respective first end 1020*a,b* and a respective second end 1022*a,b* (see also FIG. 10). Also shown in FIG. 9, arms 1018*a,b* each have a respective handle 1024*a,b* that is attached to a respective second end 1022*a,b*. In a typical embodiment of the device 1000, the handle 1024 is free to rotate about axis 1134 using an attachment well know to those skilled in the pertinent art. Additionally, the first arm 1012 and arms 1018*a,b* each have a respective lockingpin 1026*a–c* that can be manipulated in a manner well known in the art to telescopically adjust the respective lengths of the arms 1012, 1018*a* and 1018*b*.

FIG. 9 also shows that the device 1000 includes a joint assembly 1028 which, for reference purposes, defines an axis of rotation 1030. In their relationship to this axis of rotation 1030, the first arm 1012 is attached to the joint assembly 1028 to establish a fixed relationship between the first arm 1012 and the axis of rotation 1030. On the other hand, the arms 1018*a,b* are pivotally attached to the joint assembly 1028 for a reciprocal rotation of the arms 1018*a,b* about the axis of rotation 1030. More specifically, this rotation of the arms 1018*a,b* about the axis of rotation 1030 can be in either a clockwise direction 1032 or in a counterclockwise direction 1034. It is to be appreciated that the arms 1018*a,b* as shown in FIG. 9 can be rotated to other positions about the axis of rotation 1030 to establish alternate exercise configurations of the device 1000.

FIG. 9 further shows that the device 1000 includes a base member, which for the embodiment shown in FIG. 9 is a frame 1145, the construction of which is well known in the pertinent art. As shown, the frame 1145 can be attached to the second end 1016 of the first arm 1012 such that the first arm 1012 can rotate about axis 1138. Extension member 1150 extends from frame 1145 and is attached to bracket 1156 with bolt 1152 in slot 1154 of bracket 1156. Bracket 1156 is attached to first arm 1012 by means such as welding. Extension member 1150 has a locking pin 1151 that can be manipulated in a manner well know in the art to telescopically adjust the length of extension member 1150. Bolt 1152 is free to slide in slot 1154 of bracket 1156 when the length of extension member 1150 is adjusted, thus allowing first arm 1012 to rotate about axis 1138. In a typical embodiment, locking pin 1153 can be removed to allow the joint assembly 1028 to be rotated about axis 1136 to change the orientation of the joint assembly 1028 relative to first arm 1012. Locking pin 1153 is then reinserted to lock the joint assembly 1028 in position.

FIG. 9 further shows that a position sensor 1038 can be mounted on the device 1000, possibly at the joint assembly 1028, to generate signals that are representative of the relative positions of the first arm 1012 and the arms 1018*a,b* of the device 1000. Specifically, these signals can be generated in a manner well known in the pertinent art and transmitted to a remote computer (such as the computer 42 shown in FIG. 1) or other electronic monitoring device for processing. More specifically, the signals can be used to indicate the position of the first arm 1012 relative to the arms 1018*a,b*, and to measure the time duration between changes in the relative positions of said first arm 1012 and the arms 1018*a,b* of the device 1000. It is further envisioned that a load sensor 1106, such as a strain gauge, can be mounted on the device 1000, possibly near handle 1024*a*, to generate signals that are representative of the loads that are applied to the handle 1024*a* of device 1000. These signals also can be generated in a manner well known in the pertinent art and transmitted to a remote computer or other electronic monitoring device for processing and displaying useful information regarding exercise sessions. Thus, exercise repetitions, the duration of each repetition, and the load applied by the user during each repetition in an exercise routine can be monitored. Furthermore, other exercise performance information and data can be determined from the signals.

Figure 10:
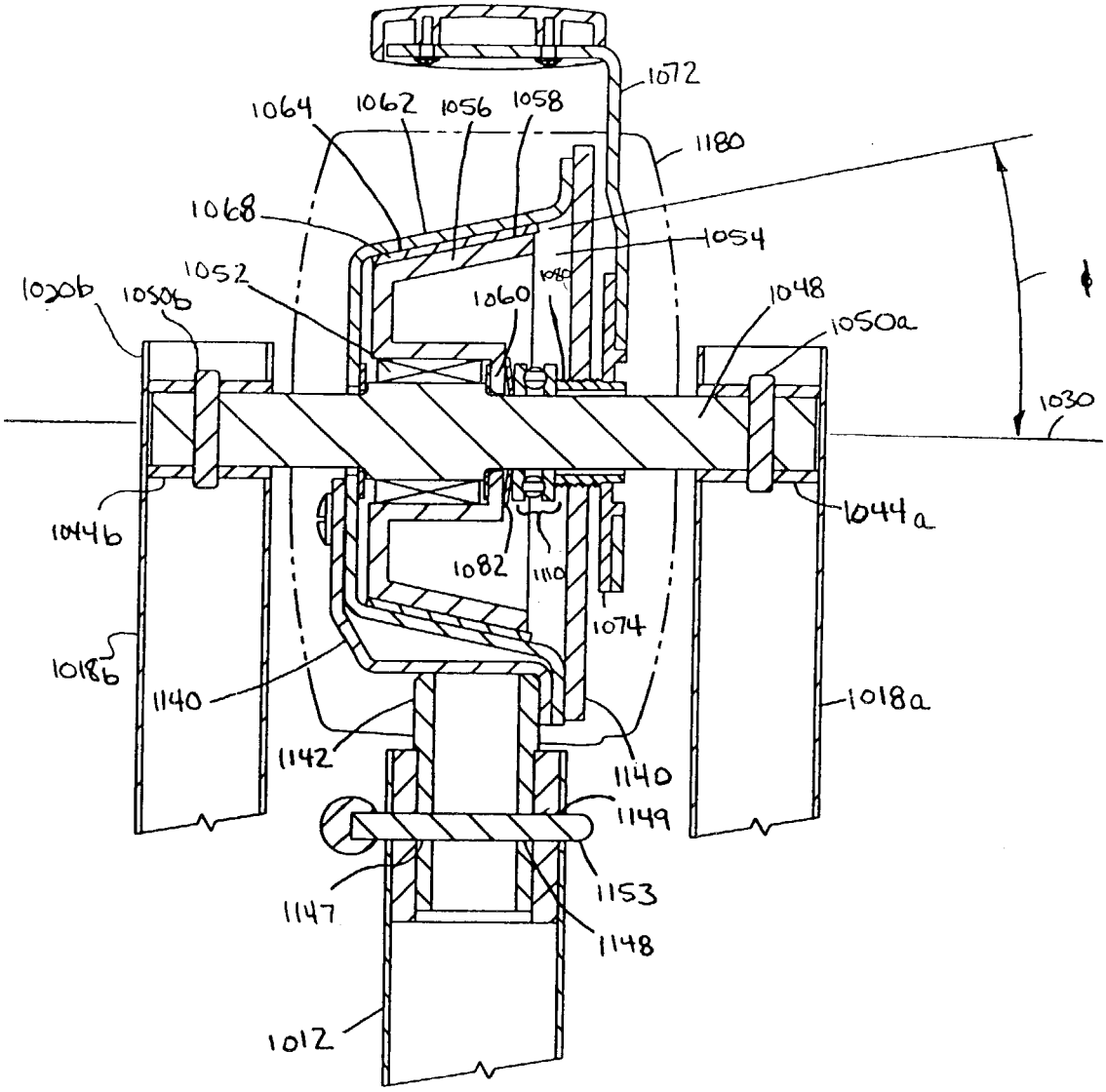
FIG. 10 is a cross sectional view of a joint assembly for an exercise device as would be seen along line 10—10 in FIG. 9, after the arms have been rotated to become parallel.

Turning now to FIG. 10, the resistance mechanism that is incorporated into the joint assembly 1028 of the device 1000 is shown in detail. There it can be seen that the arms 1018*a,b* are each connected to a respective tube 1044*a,b* by means, such as welding, and that the tubes 1044*a,b* are connected to a shaft 1048 by means, such as the respective pins 1050*a,b*. As shown, the shaft 1048 is centered on the axis of rotation 1030. Further, the resistance mechanism includes a circular one-way clutch 1052, of a type well known in the pertinent art. The one-way clutch 1052 may also have an integral bearing assembly. Those of ordinary skill in the art will understand, however, that the one-way clutch 1052 may comprise a variety of suitable devices. The one-way clutch 1052 is also centered on the axis of rotation 1030.

A cone member 1056 is included in the joint assembly 1028 and is positioned against the one-way clutch 1052. As further shown for the device 1000, the cone member 1056 is formed with a tapered surface 1058 that surrounds the axis of rotation 1030 and is angled relative to the axis of rotation 1030 at angle, $\phi$, which is preferably between ten and fifteen degrees. However, those of ordinary skill in the art will understand that there are many suitable values for angle $\phi$ including ninety degrees, in which case tapered surface 1058 will be substantially perpendicular to the axis of rotation 1030. Additionally, the cone member 1056 includes a rim 1060 that is oriented radially on the axis of rotation 1030. Also included in the joint assembly 1028 is a cup member 1062 which has a tapered surface 1064. As shown, the tapered surface 1064 of the cup member 1062 is dimensioned to mate with the tapered surface 1058 of the cone member 1056. As intended for the device 1000, a friction liner 1068 is positioned between the respective tapered surfaces 1058 and 1064 of the cone member 1056 and the cup member 1062. Preferably, the friction liner 1068 is fixed to either the cone member 1056 or the cup member 1062. Also, the cup member 1062 is formed with a space 1054.

Figure 11:
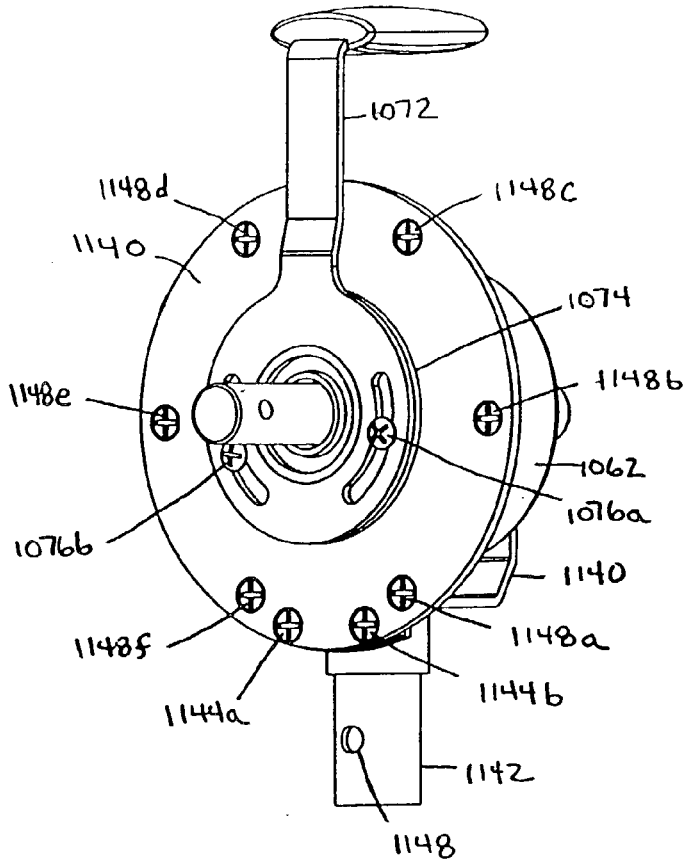
FIG. 11 is a perspective, right side view of the joint assembly shown in FIG. 10.
Figure 12:
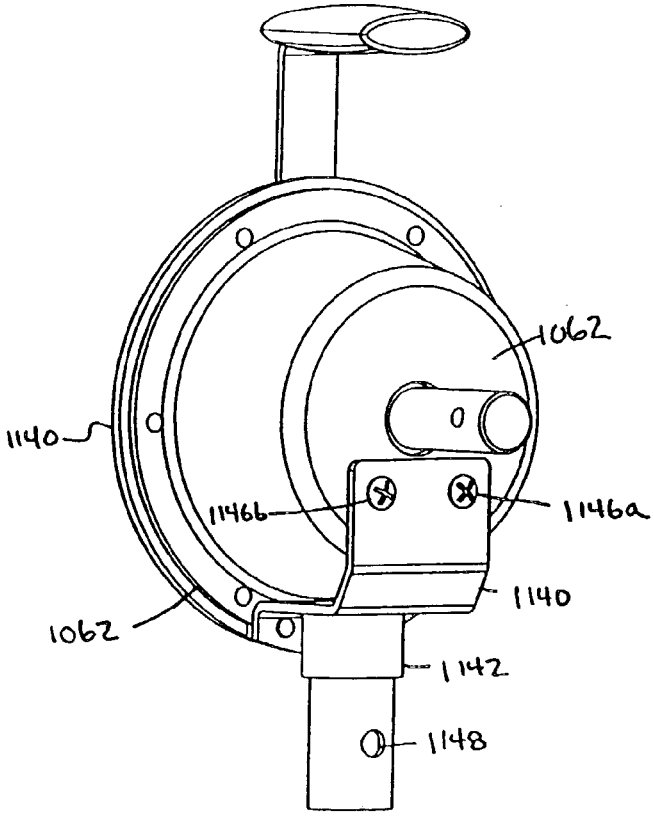
FIG. 12 is a perspective, left side view of the joint assembly shown in FIG. 10.

Still referring to FIG. 10, it is seen that the joint assembly 1028 includes a lever 1072 that is connected to a disc 1074 by means such as the screws 1076*a* and 1076*b* (FIG. 11). Disc 1074 is attached directly to threaded extension 1080 by means such as welding or other means well know to those in the art. Alternatively, disc 1074 and threaded extension 1080 can be formed as one part. Further, the threaded extension 1080 is threadably engaged with a plate 1140. Plate 1140 is attached to cup member 1062 by screws 1148*a*, 1148*b*, 1148*c*, 1148*d*, 1148*e* and 1148*f* (FIG. 11). Further, bracket 1140 is attached to the cup member 1062 and plate 1140 by screws 1144*a* and 1144*b* (FIG. 11) and to cup member 1062 by screws 1146*a* and 1146*b* (FIG. 12). Post 1142 is attached to bracket 1140 by means such as welding. Post 1142 is attached to arm 1012 by means such as pin 1153. In a typical embodiment, post 1142 can rotate within first arm 1012, about axis 1136, and be removed from first arm 1012 by first removing pin 1153 from hole 1147 in post 1142 and hole 1149 in first arm 1012.

Additionally, the joint assembly 1028 includes an adjustable force transfer mechanism. The adjustable force transfer mechanism includes a spring 1082 and a thrust bearing 1110 that are positioned between the end of threaded extension 1080 and the rim 1060 of cone member 1056. The relative position of spring 1082 and thrust bearing 1110 is interchangeable. Preferably, spring 1082 is a belleville washer and thrust bearing 1110 is a thrust ball and cage assembly and two thrust washers. However, those of ordinary skill in the art will understand the spring 1082 and the thrust bearing 1110 may comprise a variety of suitable devices. An optional housing member 1180 is shown in phantom.

Figure 13:
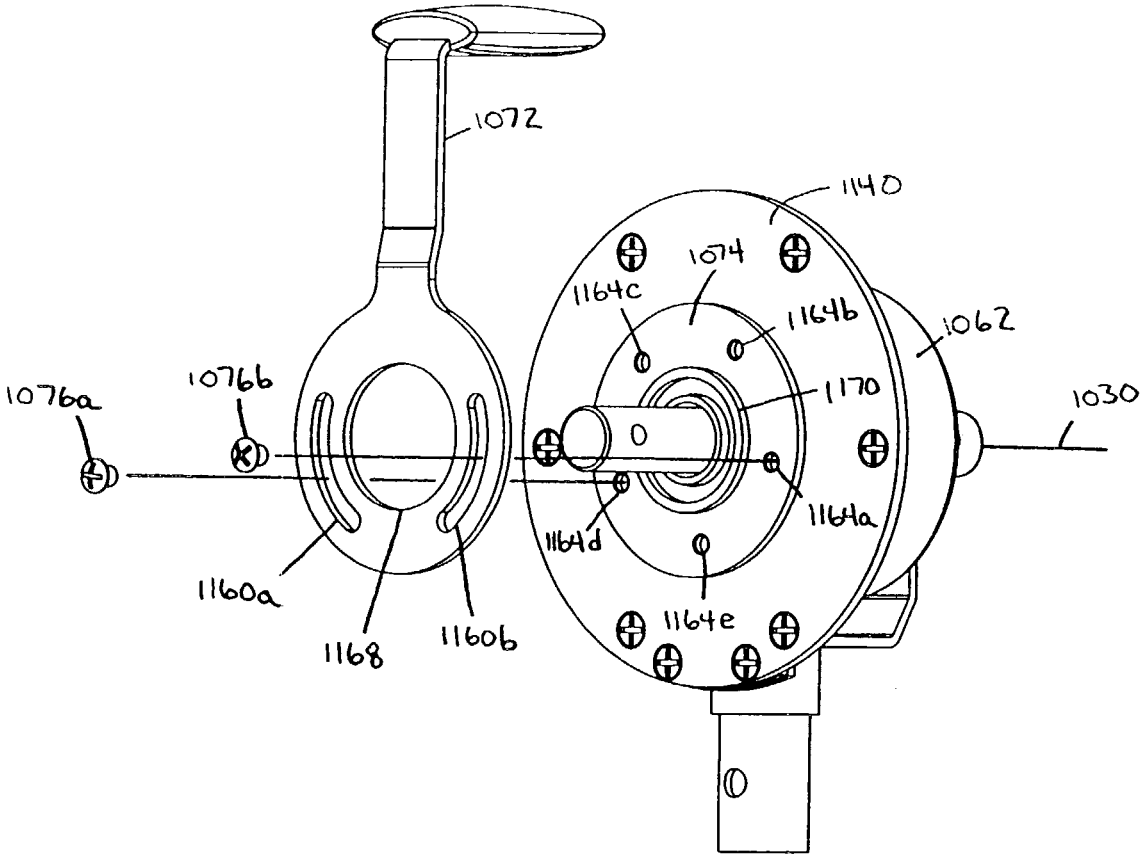
FIG. 13 is a partially exploded right side perspective view of the joint assembly shown in FIG. 10.

Turning to FIG. 13, it can be seen that the lever 1072 is formed with slots 1160*a* and 1160*b* and hole 1168. Further, disc 1074 is formed with a plurality of threaded holes 1164*a*, 1164*b*, 1164*c*, 1164*d* and 1164*e* and a raised annular flange 1170. Hole 1168 in lever 1072 and annular flange 1170 on disc 1074 are dimensioned to allow guided rotation of lever 1072 about annular flange 1170 on disc 1074. When lever 1072 is positioned on disc 1074, regardless of the orientation of lever 1072 about axis of rotation 1030, at least one of the threaded holes 1164 will be exposed in each of slots 1160*a* and 1160*b*. Screw 1076*a* is inserted through slot 1160*a* in lever 1072 and threaded into the exposed hole 1164 in disc 1074. Likewise, screw 1076*b* is inserted through slot 1160*b* in arm 1072 and threaded into the exposed hole 1164 in disc 1074. During the assembly of joint assembly 1028, threaded extension 1080 can be threaded into plate 1140 to any depth desired and then arm 1072 can be assembled to disc 1074 at any radial position about axis of rotation 1030. This assembly procedure provides a means for calibrating the joint assembly 1028. Preferably, disc 1074 has five threaded holes, 1164*a*, 1164*b*, 1164*c*, 1164*d* and 1164*e*, equally spaced circumferentially about annular flange 1170. Lever 1072 has two slots, 1160*a* and 1160*b*, each extending approximately 72° circumferentially about hole 1168 and spaced apart approximately 72° circumferentially about hole 1168. However, those of ordinary skill in the art will understand that there are many configurations and combinations of slots 1160 in arm 1072 and threaded holes 1164 in disc 1074 that are suitable.

In the operation of the device 1000, a user 1090 will first adjust the exercise resistance that is to be provided by the joint assembly 1028. Specifically, this is accomplished by rotating the lever 1072. With reference to FIG. 10, it will be appreciated by a skilled artisan that a rotation of the lever 1072 causes the threaded extension 1080 to interact with the plate 1140 in a way that will effect a translational movement of the threaded extension 1080. Accordingly, depending on the direction that lever 1072 is rotated, the threaded extension 1080 will either advance into the space 1054 or be withdrawn from the space 1054. The consequence of this is that the adjustable force transfer mechanism (which in this case includes spring 1082) will be respectively relaxed or compressed between the end of the threaded extension 1080 and the rim 1060 of cone member 1056. In either case, the force that is generated by the spring 1082 will act against the cone member 1056. Importantly, this force will be effectively transferred through the cone member 1056 to establish a reactive force on the friction liner 1068 at the interface between the tapered surface 1058 of the cone member 1056 and the tapered surface 1064 of the cup member 1062. Furthermore, utilizing an adjustable force transfer mechanism allows the lever 1072 to be rotated through larger angles in adjusting the exercise resistance from its lowest setting to its highest setting than would be possible if an adjustable force transfer mechanism was not employed.

Through the action of the one-way clutch 1052, the arms 1018*a,b* are able to freely rotate about the axis of rotation 1030 when the arms 1018*a,b* are rotated in a predetermined direction, e.g. the clockwise direction 1032. On the other hand, the one-way clutch 1052 will fixedly engage the arms 1018*a,b* with the cone member 1056 when the arms 1018*a,b* are rotated in the opposite direction, e.g. the counterclockwise direction 1034. As a consequence, when the arms 1018*a,b* are fixedly engaged with the cone member 1056 through the one-way clutch 1052, the rotation of the arms 1018*a,b* will encounter the resistance that is established on the friction liner 1068 between the cone member 1056 and the cup member 1062. As indicated above, the amount of this resistance is established by rotating the lever 1072. Through the action of thrust bearing 1110, the threaded extension 1080, disc 1074 and lever 1072 are prevented from rotating when the action of the one-way clutch 1052 causes cone 1056 to rotate with respect to cup 1062 as arms 1018*a,b* are rotated. Further, a visible gauge (not shown), can be used for determining preferred resistance levels.

Figure 14A:
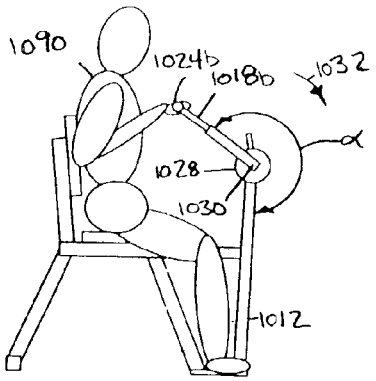
FIGS. 14A and 14B show an exercise device configured for exercising the chest of a user.
Figure 14B:
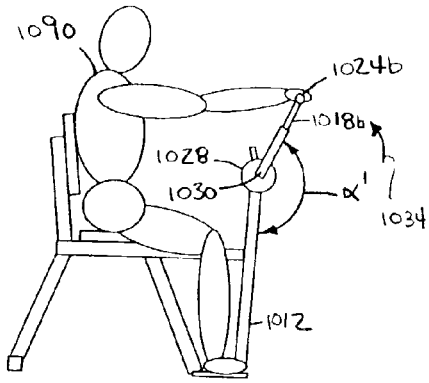

FIGS. 14A and 14B show an exemplary use of the device 1000 wherein the axis of rotation 1030 is positioned to exercise the chest of user 1090. Rotation of one or both of the handles 1024*a,b* by the user 1090 in a clockwise direction 1032 (FIG. 14A) will be met by a resistance force generated by the joint assembly 1028 as the arms 1018*a,b* are rotated about the axis of rotation 1030. Conversely, rotation of the handles 1024*a,b* by the user 1090 in a counterclockwise direction 1034 (FIG. 14B) will meet no resistance from the joint assembly 1028 as the arms 1018*a,b* are rotated about the axis of rotation 1030. Further, the direction in which the resistance force acts can be reversed by first removing pin 1153 (FIG. 9), rotating the joint assembly 1028 approximately one hundred and eighty degrees about axis 1136 (FIG. 9), and reinserting pin 1153. The arm 1012, arms 1018*a,b* and extension member 1150 can be lengthened or shortened to effect other exercises.

Figure 15A:
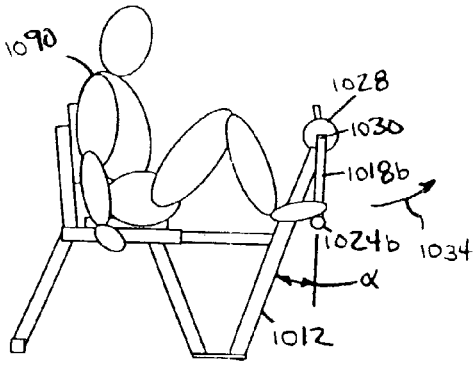
FIGS. 15A and 15B show an exercise device configured for exercising the lower body of a user.
Figure 15B:
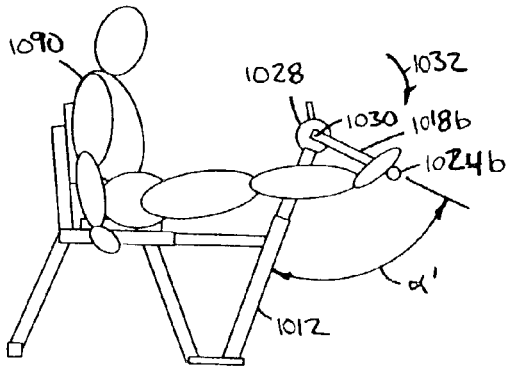

FIGS. 15A and 15B show a use of the device 1000 for exercising the lower body of user 1090 wherein the joint assembly 1028 is oriented such that rotation of the handles 1024*a,b* by the user 1090 in a counterclockwise direction 1034 (FIG. 15A) will be met by a resistance force generated by the joint assembly 1028 as the arms 1018*a,b* are rotated about the axis of rotation 1030. Conversely, rotation of the handles 1024*a,b* by the user 1090 in a clockwise direction 1032 (FIG. 15B) will be meet with no resistance from the joint assembly 1028 as the arms 1018*a,b* are rotated about the axis of rotation 1030.

Figure 16A:
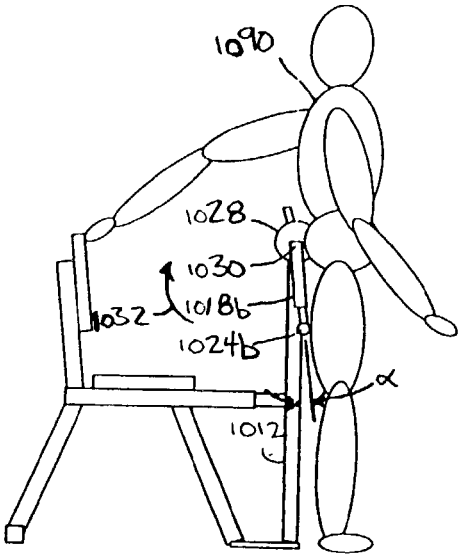
FIGS. 16A and 16B show an exercise device configured for exercising the gluteus maximus muscle of a user that is in a standing position.
Figure 16B:
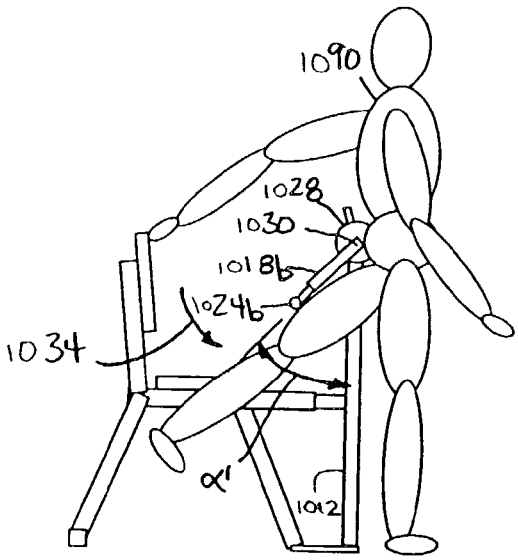

FIGS. 16A and 16B show a use of the device 1000 for exercising the gluteus maximus muscle of the user 1090 wherein the user 1090 is in a standing position. The joint assembly 1028 is oriented such that rotation of the handles 1024*a,b* by the user 1090 in a clockwise direction 1032 (FIG. 16A) will be met by a resistance force generated by the joint assembly 1028 as the arms 1018*a,b* are rotated about the axis of rotation 1030. Conversely, rotation of the handles 1024*a,b* by the user 1090 in a counterclockwise direction 1034 (FIG. 16B) will be meet with no resistance from the joint assembly 1028 as the arms 1018*a,b* are rotated about the axis of rotation 1030.

Regardless which embodiment of the device 1000 is contemplated, the position sensor 1038 can be used to monitor or guide the exercise routine of the user 1090. For example, in addition to signals containing time information data, the signals can also convey information about the relative positions of the first arm 1012 and arms 1018*a,b* of the device 1000. Thus, returning to FIGS. 14A and 14B, the signals can include information on the angle a between the arm 1012 and arms 1018*a,b* (FIG. 14A), and changes in this angle $\alpha$ to the angle $\alpha'$ (FIG. 14B). Furthermore, the load sensor 1106, either in combination with the position sensor 1038 or alone, can be used with any of the embodiments of the device 1000 to monitor or guide the exercise routine of the user 1090. The signals can also contain data regarding the magnitude of the force applied by the user 1090 to the device 1000 to overcome the resistance force generated by the joint assembly 1028 as the arms 1018*a,b* are rotated from a position at angle $\alpha$ from arm 1012 (FIG. 14A) to a position at angle $\alpha'$ from arm 1012 (FIG. 14B). Additionally, the signals can contain data regarding the magnitude and relative direction of the force applied by the user 1090 of the device 1000 in returning the arms 1018*a,b* from angle $\alpha'$ to angle $\alpha$. Such information and data, of course, can be useful for monitoring both the duration and the extent of exercise routines conducted with the device 1000 as well as the magnitude of the loads applied to the device 1000 by the user 1090 during the exercise routines. This information and data can also be used by a computer or other electronic monitoring devices to perform calculations and analysis of the exercise routines.

While the particular exercise device with true pivot point as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An exercise device which comprises:

a base member;

a first arm having a first end and a second end with said second end being pivotally attached to said base member for rotation about a first axis relative thereto;

a second arm having a first end and a second end;

a joint assembly defining a second axis of rotation, said first end of said first arm being attached to said joint assembly to establish a fixed relationship between said first arm and said second axis, with said first end of said second arm being pivotally attached to said joint assembly for rotation of said second arm about said second axis;

a shaft mounted on said joint assembly and fixedly interconnected with said second arm;

a one-way clutch engageable with said shaft;

a cone member engaged with said one-way clutch for free rotation of said second arm relative to said cone member around said second axis in a second direction, and for rotation of said second arm with said cone member around said second axis in a first direction, said cone member having a surface; and a cup member fixedly attached to said first arm, said cup member having a surface dimensioned for a mating engagement with said surface of said cone member at an interface therebetween to establish a resistance to said rotation of said second arm.

2. An exercise device as recited in claim 1 further comprising:

an adjustable force transfer mechanism for selectively urging said surface of said cone member against said surface of said cup member to selectively establish said resistance.

3. An exercise device as recited in claim 2 wherein said adjustable force transfer mechanism comprises:

a plate attached to said cup member;

a threaded extension threadably engaged with said plate;

a spring interposed between said threaded extension and said cone member; and a lever for rotating said threaded extension to selectively compress said spring.

4. An exercise device as recited in claim 3 wherein said adjustable force transfer mechanism further comprises:

a thrust bearing to facilitate relative motion between said threaded extension and said cone member.

5. An exercise device as recited in claim 1 further comprising a third arm mounted on said shaft and oriented parallel with said second arm.

6. An exercise device as recited in claim 1 further comprising a friction liner positioned at said interface between said surface of said cone member and said surface of said cup member.

7. An exercise device as recited in claim 1 wherein said base member comprises a seat.

8. An exercise device as recited in claim 1 wherein said first arm is extensible to selectively vary the distance between said first axis and said second axis.

9. An exercise device as recited in claim 1 further comprising:

a load sensor mounted on said device to generate signals representative of the magnitude of said resistance to said rotation of said second arm; and a means for monitoring said signals.

10. An exercise device as recited in claim 1 further comprising:

a position sensor mounted onto said device to generate signals representative of the relative positions of said first arm and said second arm for said device; and a means for monitoring said signals.

11. An exercise device which comprises:

a first arm having a first end and a second end;

a second arm having a first end and a second end;

a cup member fixedly attached to said first arm, said cup member having a surface;

a cone member for engagement with said second arm, said cone member defining an axis, said cone member disposed in said cup for rotation relative thereto about said axis, said cone member having a surface conforming with said surface of said cup member to establish an interface therebetween;

a plate attached to said cup member;

a threaded extension threadably engaged with said plate;

a spring interposed between said threaded extension and said cone member; and a lever for rotating said threaded extension to selectively compress said spring and establish a rotation resistance between said cup member and said cone member at said interface.

12. An exercise device as recited in claim 11 further comprising a one-way clutch for interconnecting said second arm with said cone to engage said second arm with said cone in response to a rotation of said second arm in a first direction and to disengage said second arm with said cone in response to a rotation of said second arm in a second direction.

13. An exercise device as recited in claim 11 further comprising a friction liner positioned at said interface between said surface of said cone member and said surface of said cup member.

14. An exercise device as recited in claim 11 further comprising a base member having a seat and wherein said first arm is pivotally attached to said base member.

15. An exercise device as recited in claim 14 wherein said first arm is extensible to selectively move said axis relative to said base member.

16. An exercise device which comprises:

a shaft having a first end and a second end;

a first arm having a first end and a second end;

a second arm having a first end attached to said first end of said shaft and a second end;

a third arm having a first end attached to said second end of said shaft and a second end;

a joint assembly defining an axis of rotation, said first end of said first arm being attached to said joint assembly to establish a fixed relationship between said first arm and said axis, with said shaft being attached to said joint assembly for rotation about said axis;

a one-way clutch engageable with said shaft;

a cone member engaged with said one-way clutch for free rotation of said second arm relative to said cone member around said axis in a second direction, and for rotation of said second arm with said cone member around said axis in a first direction, said cone member having a surface; and a cup member fixedly attached to said first arm, said cup member having a surface dimensioned for a mating engagement with said surface of said cone member at an interface therebetween to establish a resistance to said rotation of said second arm.

17. An exercise device as recited in claim 16 further comprising:

an adjustable force transfer mechanism for selectively urging said surface of said cone member against said surface of said cup member to selectively establish said resistance.

18. An exercise device as recited in claim 17 wherein said adjustable force transfer mechanism comprises:

a plate attached to said cup member;

a threaded extension threadably engaged with said plate;

a spring interposed between said threaded extension and said cone member; and a lever for rotating said threaded extension to selectively compress said spring.

19. An exercise device as recited in claim 16 further comprising a base and wherein said second end of said first arm is pivotally attached to said base member.

* * * * *

UNITED STATES PATENT AND TRADEMARK OFFICE

CERTIFICATE OF CORRECTION

PATENT NO. : 7,223,215 B2
APPLICATION NO. : 10/464949
DATED : May 29, 2007
INVENTOR(S) : Charles A. Bastyr It is certified that error appears in the above-identified patent and that said Letters Patent is hereby corrected as shown below:

Column 6, Line 12
DELETE
" FIG. 0.1 "
INSERT
-- FIG. 1 --

Column 14, Line 22
DELETE
" a "
INSERT
-- α --

Signed and Sealed this

Thirty-first Day of July, 2007

JON W. DUDAS
*Director of the United States Patent and Trademark Office*